US008284107B2

(12) United States Patent
Borisov et al.

(10) Patent No.: US 8,284,107 B2
(45) **Date of Patent: *Oct. 9, 2012**

(54) RF LOCAL AREA NETWORK ANTENNA DESIGN

(75) Inventors: Vladimir Borisov, Seneca, SC (US); Joseph Pontin, Seneca, SC (US)

(73) Assignee: Itron, Inc., Liberty Lake, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/955,616

(22) Filed: Nov. 29, 2010

(65) Prior Publication Data

US 2011/0115682 A1 May 19, 2011

Related U.S. Application Data

(63) Continuation of application No. 11/899,621, filed on Sep. 6, 2007, now Pat. No. 7,843,391.

(60) Provisional application No. 60/845,061, filed on Sep. 15, 2006.

(51) Int. Cl.
*H01Q 1/30* (2006.01)
*H01P 11/00* (2006.01)

(52) U.S. Cl. ..... 343/700 MS; 343/845; 343/850; 29/600

(58) Field of Classification Search ..... 343/700 MS, 343/845, 850; 29/600, 601
See application file for complete search history.

(56) References Cited

U.S. PATENT DOCUMENTS 4,387,296 A 6/1983 Newell et al.
4,588,856 A 5/1986 Cohen
4,614,945 A 9/1986 Brunius et al.
4,633,486 A 12/1986 Berlekamp et al.
4,654,662 A 3/1987 Van Orsdel
4,737,797 A 4/1988 Siwiak et al.
4,744,004 A 5/1988 Hammond
4,780,910 A 10/1988 Huddleston et al.
4,786,903 A 11/1988 Grindahl et al.
4,799,062 A 1/1989 Sanderford, Jr. et al.
4,800,393 A 1/1989 Edward et al.
(Continued)

FOREIGN PATENT DOCUMENTS

CN 2247819 2/1997
(Continued)

OTHER PUBLICATIONS

PCT International Search Report for PCT International Application No. PCT/US07/19595; Date of mailing: May 1, 2008.
(Continued)

*Primary Examiner* — Dieu H Duong
(74) *Attorney, Agent, or Firm* — Dority & Manning, P.A.

(57) ABSTRACT

Disclosed are apparatus and methodology subject matters relating to an antenna configured for mounting under the glass in a utility meter. The antenna is configured as a patch antenna where a radiating element is mounted on one side of a plastic substrate while a conductive ground plane element is mounted on the other side of the substrate. The ground plane element faces the meter electronics and thereby provides protection to the electronics from the electromagnetic field of the antenna. Both the radiating element and ground plane element may be provided by hot stamping conductive material directly on to the front and rear surfaces of the substrate. The antenna may be feed by a microstrip feedline mounted on the printed circuit board supporting other meter components.

21 Claims, 3 Drawing Sheets

U.S. PATENT DOCUMENTS

| | | | |
|---|---|---|---|
| 4,804,957 | A | 2/1989 | Selph et al. |
| 4,825,220 | A | 4/1989 | Edward et al. |
| 4,904,995 | A | 2/1990 | Bonner et al. |
| 4,924,236 | A | 5/1990 | Schuss et al. |
| 4,977,577 | A | 12/1990 | Arthur et al. |
| 4,998,102 | A | 3/1991 | Wyler et al. |
| 5,010,568 | A | 4/1991 | Merriam et al. |
| 5,014,213 | A | 5/1991 | Edwards et al. |
| 5,056,107 | A | 10/1991 | Johnson et al. |
| 5,067,136 | A | 11/1991 | Arthur et al. |
| 5,095,493 | A | 3/1992 | Arthur et al. |
| 5,119,396 | A | 6/1992 | Snderford, Jr. |
| 5,198,796 | A | 3/1993 | Hessling, Jr. |
| 5,265,120 | A | 11/1993 | Sanderford, Jr. |
| 5,270,639 | A | 12/1993 | Moore |
| 5,310,075 | A | 5/1994 | Wyler |
| 5,311,541 | A | 5/1994 | Sanderford, Jr. |
| 5,377,222 | A | 12/1994 | Sanderford, Jr. |
| 5,377,232 | A | 12/1994 | Davidov et al. |
| 5,448,230 | A | 9/1995 | Schanker et al. |
| 5,457,713 | A | 10/1995 | Sanderford, Jr. et al. |
| 5,486,755 | A | 1/1996 | Horan et al. |
| 5,486,805 | A | 1/1996 | Mak |
| 5,519,387 | A | 5/1996 | Besier et al. |
| 5,541,589 | A | 7/1996 | Delaney |
| 5,553,094 | A | 9/1996 | Johnson et al. |
| 5,598,427 | A | 1/1997 | Arthur et al. |
| 5,602,744 | A | 2/1997 | Meek et al. |
| 5,604,768 | A | 2/1997 | Fulton |
| 5,617,084 | A | 4/1997 | Sears |
| 5,626,755 | A | 5/1997 | Keyser et al. |
| 5,659,300 | A | 8/1997 | Dresselhuys et al. |
| 5,661,750 | A | 8/1997 | Fulton |
| 5,668,828 | A | 9/1997 | Sanderford, Jr. et al. |
| 5,678,201 | A | 10/1997 | Thill |
| 5,696,441 | A | 12/1997 | Mak et al. |
| 5,708,446 | A | 1/1998 | Laramie |
| 5,711,675 | A | 1/1998 | Nishitani et al. |
| 5,719,564 | A | 2/1998 | Sears |
| RE35,829 | E | 6/1998 | Sanderford, Jr. |
| 5,801,643 | A | 9/1998 | Williams et al. |
| 5,808,558 | A | 9/1998 | Meek et al. |
| 5,826,195 | A | 10/1998 | Westerlage et al. |
| 5,844,523 | A | 12/1998 | Brennan et al. |
| 5,847,683 | A | 12/1998 | Wolfe et al. |
| 5,892,758 | A | 4/1999 | Argyroudis |
| 5,896,097 | A | 4/1999 | Cardozo |
| 5,909,640 | A | 6/1999 | Farrer et al. |
| 5,914,673 | A | 6/1999 | Jennings et al. |
| 5,920,589 | A | 7/1999 | Rouquette et al. |
| 5,926,531 | A | 7/1999 | Petite |
| 5,933,072 | A | 8/1999 | Kelley |
| 5,953,368 | A | 9/1999 | Sanderford et al. |
| 5,966,010 | A | 10/1999 | Loy et al. |
| 5,986,574 | A | 11/1999 | Colton |
| 5,987,058 | A | 11/1999 | Sanderford et al. |
| 5,995,593 | A | 11/1999 | Cho |
| 6,014,089 | A | 1/2000 | Tracy et al. |
| 6,016,432 | A | 1/2000 | Stein |
| 6,028,522 | A | 2/2000 | Petite |
| 6,031,883 | A | 2/2000 | Sanderford, Jr. et al. |
| 6,044,062 | A | 3/2000 | Brownrigg et al. |
| 6,047,016 | A | 4/2000 | Ramberg et al. |
| 6,067,052 | A | 5/2000 | Rawles et al. |
| 6,069,571 | A | 5/2000 | Tell |
| 6,078,785 | A | 6/2000 | Bush |
| 6,100,816 | A | 8/2000 | Moore |
| 6,150,955 | A | 11/2000 | Tracy et al. |
| 6,163,276 | A | 12/2000 | Irving et al. |
| 6,177,883 | B1 | 1/2001 | Jennetti et al. |
| 6,178,197 | B1 | 1/2001 | Froelich et al. |
| 6,181,258 | B1 | 1/2001 | Summers et al. |
| 6,181,294 | B1 | 1/2001 | Porter et al. |
| 6,195,018 | B1 | 2/2001 | Ragle et al. |
| 6,208,266 | B1 | 3/2001 | Lyons et al. |
| 6,218,953 | B1 | 4/2001 | Petite |
| 6,222,503 | B1 | 4/2001 | Gietema et al. |
| 6,232,885 | B1 | 5/2001 | Ridenour et al. |
| 6,233,327 | B1 | 5/2001 | Petite |
| 6,246,677 | B1 | 6/2001 | Nap et al. |
| 6,249,516 | B1 | 6/2001 | Brownrigg et al. |
| 6,262,685 | B1 | 7/2001 | Welch et al. |
| 6,263,009 | B1 | 7/2001 | Ramberg et al. |
| 6,271,792 | B1 | 8/2001 | Sletten et al. |
| 6,304,231 | B1 | 10/2001 | Reed |
| 6,335,953 | B1 | 1/2002 | Sanderford, Jr. et al. |
| 6,363,057 | B1 | 3/2002 | Ardalan et al. |
| 6,369,769 | B1 | 4/2002 | Nap et al. |
| 6,377,609 | B1 | 4/2002 | Brennan, Jr. |
| 6,396,839 | B1 | 5/2002 | Ardalan et al. |
| 6,411,219 | B1 | 6/2002 | Slater |
| 6,414,605 | B1 | 7/2002 | Walden et al. |
| 6,424,270 | B1 | 7/2002 | Ali |
| 6,426,027 | B1 | 7/2002 | Scarborough, III et al. |
| 6,430,268 | B1 | 8/2002 | Petite |
| 6,437,692 | B1 | 8/2002 | Petite et al. |
| 6,452,986 | B1 | 9/2002 | Luxford et al. |
| 6,456,644 | B1 | 9/2002 | Ramberg et al. |
| 6,538,577 | B1 | 3/2003 | Ehrke et al. |
| 6,604,434 | B1 | 8/2003 | Hamilton et al. |
| 6,612,188 | B2 | 9/2003 | Hamilton |
| 6,617,879 | B1 | 9/2003 | Chung |
| 6,617,976 | B2 | 9/2003 | Walden et al. |
| 6,617,978 | B2 | 9/2003 | Ridenour et al. |
| 6,618,578 | B1 | 9/2003 | Petite |
| 6,626,048 | B1 | 9/2003 | Dam Es et al. |
| 6,628,764 | B1 | 9/2003 | Petite |
| 6,639,939 | B1 | 10/2003 | Naden et al. |
| 6,650,249 | B2 | 11/2003 | Meyer et al. |
| 6,657,552 | B2 | 12/2003 | Belski et al. |
| 6,671,586 | B2 | 12/2003 | Davis et al. |
| 6,700,902 | B1 | 3/2004 | Meyer |
| 6,704,301 | B2 | 3/2004 | Chari et al. |
| 6,734,663 | B2 | 5/2004 | Fye et al. |
| 6,738,026 | B1 | 5/2004 | McKivergan et al. |
| 6,747,557 | B1 | 6/2004 | Petite et al. |
| 6,747,981 | B2 | 6/2004 | Ardalan et al. |
| 6,778,099 | B1 | 8/2004 | Meyer et al. |
| 6,784,807 | B2 | 8/2004 | Petite et al. |
| 6,816,538 | B2 | 11/2004 | Hodges et al. |
| 6,819,292 | B2 | 11/2004 | Winter |
| 6,836,108 | B1 | 12/2004 | Balko et al. |
| 6,836,737 | B2 | 12/2004 | Petite et al. |
| 6,850,197 | B2 | 2/2005 | Paun |
| 6,859,186 | B2 | 2/2005 | Lizalek et al. |
| 6,862,498 | B2 | 3/2005 | Davis et al. |
| 6,867,707 | B1 | 3/2005 | Kelley et al. |
| 6,885,309 | B1 | 4/2005 | Van Heteren |
| 6,891,838 | B1 | 5/2005 | Petite et al. |
| 6,900,737 | B1 | 5/2005 | Ardalan et al. |
| 6,914,533 | B2 | 7/2005 | Petite |
| 6,914,893 | B2 | 7/2005 | Petite |
| 6,918,311 | B2 | 7/2005 | Nathan |
| 6,931,445 | B2 | 8/2005 | Davis |
| 6,940,396 | B2 | 9/2005 | Hammond et al. |
| 6,965,575 | B2 | 11/2005 | Srikrishna et al. |
| 6,972,555 | B2 | 12/2005 | Balko et al. |
| 6,982,651 | B2 | 1/2006 | Fischer |
| 6,989,790 | B1 | 1/2006 | Rees |
| 7,046,682 | B2 | 5/2006 | Carpenter et al. |
| 7,047,076 | B1 | 5/2006 | Li et al. |
| 7,054,271 | B2 | 5/2006 | Brownrigg et al. |
| 7,103,511 | B2 | 9/2006 | Petite |
| 7,126,494 | B2 | 10/2006 | Ardalan et al. |
| 7,186,377 | B2 | 3/2007 | Iyama et al. |
| 7,196,673 | B2 | 3/2007 | Savage et al. |
| 7,286,098 | B2 | 10/2007 | Ogino et al. |
| 7,321,336 | B2 | 1/2008 | Phillips et al. |
| 7,551,141 | B1 | 6/2009 | Hadley et al. |
| 7,671,814 | B2 | 3/2010 | Savage et al. |
| 7,761,249 | B2 | 7/2010 | Ramirez |
| 7,812,771 | B2 | 10/2010 | Greene et al. |
| 7,843,391 | B2 | 11/2010 | Borisov et al. |
| 2002/0019725 | A1 | 2/2002 | Petite |
| 2002/0146985 | A1 | 10/2002 | Naden |
| 2002/0158774 | A1 | 10/2002 | Johnson et al. |
| 2002/0169643 | A1 | 11/2002 | Petite et al. |

2003/0048199 A1 3/2003 Zigdon et al.
2003/0063723 A1 4/2003 Booth et al.
2003/0078029 A1 4/2003 Petite
2003/0093484 A1 5/2003 Petite
2003/0103486 A1 6/2003 Salt et al.
2003/0179143 A1 9/2003 Iwai et al.
2003/0179149 A1 9/2003 Savage et al.
2004/0004555 A1 1/2004 Martin
2004/0008663 A1 1/2004 Srikrishna et al.
2004/0023638 A1 2/2004 Reading
2004/0040368 A1 3/2004 Guckenberger et al.
2004/0053639 A1 3/2004 Petite et al.
2004/0061623 A1 4/2004 Tootoonian Mashhad et al.
2004/0062224 A1 4/2004 Brownrigg et al.
2004/0085928 A1 5/2004 Chari et al.
2004/0088083 A1 5/2004 Davis et al.
2004/0131125 A1 7/2004 Sanderford, Jr. et al.
2004/0183687 A1 9/2004 Petite et al.
2004/0192415 A1 9/2004 Luglio et al.
2004/0218616 A1 11/2004 Ardalan et al.
2004/0264379 A1 12/2004 Srikrishna et al.
2004/0264435 A1 12/2004 Chari et al.
2005/0024235 A1 2/2005 Shuey et al.
2005/0030199 A1 2/2005 Petite et al.
2005/0036487 A1 2/2005 Srikrishna
2005/0043059 A1 2/2005 Petite et al.
2005/0043860 A1 2/2005 Petite
2005/0052290 A1 3/2005 Naden et al.
2005/0052328 A1 3/2005 De Angelis
2005/0068970 A1 3/2005 Srikrishna et al.
2005/0074015 A1 4/2005 Chari et al.
2005/0129005 A1 6/2005 Srikrishna et al.
2005/0147097 A1 7/2005 Chari et al.
2005/0162149 A1 7/2005 Makinson et al.
2005/0163144 A1 7/2005 Srikrishna et al.
2005/0169020 A1 8/2005 Knill
2005/0171696 A1 8/2005 Naden et al.
2005/0172024 A1 8/2005 Cheifot et al.
2005/0190055 A1 9/2005 Petite
2005/0195768 A1 9/2005 Petite et al.
2005/0195775 A1 9/2005 Petite et al.
2005/0201397 A1 9/2005 Petite
2005/0218873 A1 10/2005 Shuey et al.
2005/0226179 A1 10/2005 Behroozi
2005/0243867 A1 11/2005 Petite
2005/0251401 A1 11/2005 Shuey
2005/0251403 A1 11/2005 Shuey
2005/0271006 A1 12/2005 Chari et al.
2005/0278440 A1 12/2005 Scoggins
2006/0002350 A1 1/2006 Behroozi
2006/0012935 A1 1/2006 Murphy
2006/0018303 A1 1/2006 Sugiarto et al.
2006/0038548 A1 2/2006 Shuey
2006/0043961 A1 3/2006 Loy
2006/0055610 A1 3/2006 Borisov et al.
2006/0071810 A1 4/2006 Scoggins et al.
2006/0071812 A1 4/2006 Mason, Jr. et al.
2006/0256027 A1* 11/2006 Rawnick et al. ..... 343/861
2007/0085750 A1* 4/2007 De Angelis ..... 343/767
2007/0222681 A1 9/2007 Greene et al.

FOREIGN PATENT DOCUMENTS

CN 1163404 10/1997
JP 8126085 5/1996
WO WO 96/39753 12/1996
WO WO 98/10299 3/1998

OTHER PUBLICATIONS

Automated translation of Abstract of JP 8126085.
Automated translation of Abstract of CN 2247819.
Automated translation of Abstract of CN 1163404.
Simon Guy and Simon Marvin, "Pathways to 'Smarter' Utility Meters: the Socio-technical Shaping of New Metering Technologies," pp. 1-41, Nov. 1995, School of Architecture, Planning & Landscape, Global Urban Research Unit, Centre for Urban Technology, University of Newcastle upon Tyne.
Ron A. Haberkorn and Paul E. Nikolich, "Driving Forces in Wireless Data Communications," pp. 39-47, 1Q1996, New Telecom Quarterly, Technology Futures, Inc.

* cited by examiner

RF LOCAL AREA NETWORK ANTENNA DESIGN

PRIORITY CLAIM

This application is a continuation of prior pending U.S. patent application Ser. No. 11/899,621 filed Sep. 6, 2007 entitled "RF LOCAL AREA NETWORK ANTENNA DESIGN", which claims the benefit of previously filed U.S. Provisional Patent Application of the same title, assigned U.S. Ser. No. 60/845,061 filed Sep. 15, 2006, all of which are hereby incorporated herein by reference in their entireties for all purposes.

FIELD OF THE INVENTION

The present technology relates to utility meters. More particularly, the present technology relates to an aperture coupled patch antenna design for incorporation within meters within an open operational framework employing a radio frequency local area network'(RF LAN).

BACKGROUND OF THE INVENTION

The general object of metrology is to monitor one or more selected physical phenomena to permit a record of monitored events. Such basic purpose of metrology can be applied to a variety of metering devices used in a number of contexts. One broad area of measurement relates, for example, to utility meters. Such role may also specifically include, in such context, the monitoring of the consumption or production of a variety of forms of energy or other commodities, for example, including but not limited to, electricity, water, gas, or oil.

More particularly concerning electricity meters, mechanical forms of registers have been historically used for outputting accumulated electricity consumption data. Such an approach provided a relatively dependable field device, especially for the basic or relatively lower level task of simply monitoring accumulated kilowatt-hour consumption.

The foregoing basic mechanical form of register was typically limited in its mode of output, so that only a very basic or lower level metrology function was achieved. Subsequently, electronic forms of metrology devices began to be introduced, to permit relatively higher levels of monitoring, involving different forms and modes of data.

In the context of electricity meters specifically, for a variety of management and billing purposes, it became desirable to obtain usage data beyond the basic kilowatt-hour consumption readings available with many electricity meters. For example, additional desired data included rate of electricity consumption, or date and time of consumption (so-called "time of use" data). Solid state devices provided on printed circuit boards, for example, utilizing programmable integrated circuit components, have provided effective tools for implementing many of such higher level monitoring functions desired in the electricity meter context.

In addition to the beneficial introduction of electronic forms of metrology, a variety of electronic registers have been introduced with certain advantages. Still further, other forms of data output have been introduced and are beneficial for certain applications, including wired transmissions, data output via radio frequency transmission, pulse output of data, and telephone line connection via such as modems or cellular linkups.

The advent of such variety and alternatives has often required utility companies to make choices about which technologies to utilize. Such choices have from time to time been made based on philosophical points and preferences and/or based on practical points such as, training and familiarity of field personnel with specific designs.

Another aspect of the progression of technology in such area of metrology is that various retrofit arrangements have been instituted. For example, some attempts have been made to provide basic metering devices with selected more advanced features without having to completely change or replace the basic meter in the field. For example, attempts have been made to outfit a basically mechanical metering device with electronic output of data, such as for facilitating radio telemetry linkages.

Another aspect of the electricity meter industry is that utility companies have large-scale requirements, sometimes involving literally hundreds of thousands of individual meter installations, or data points. Implementing incremental changes in technology, such as retrofitting new features into existing equipment, or attempting to implement changes to basic components which make various components not interchangeable with other configurations already in the field, can generate considerable industry problems.

Electricity meters typically include input circuitry for receiving voltage and current signals at the electrical service. Input circuitry of whatever type or specific design for receiving the electrical service current signals is referred to herein generally as current acquisition circuitry, while input circuitry of whatever type or design for receiving the electrical service voltage signals is referred to herein generally as voltage acquisition circuitry.

Electricity meter input circuitry may be provided with capabilities of monitoring one or more phases, depending on whether monitoring is to be provided in a single or multiphase environment. Moreover, it is desirable that selectively configurable circuitry may be provided so as to enable the provision of new, alternative or upgraded services or processing capabilities within an existing metering device. Such variations in desired monitoring environments or capabilities, however, lead to the requirement that a number of different metrology configurations be devised to accommodate the number of phases required or desired to be monitored or to provide alternative, additional or upgraded processing capability within a utility meter.

More recently a new ANSI protocol, ANSI C12.22, is being developed that may be used to permit open protocol communications among metrology devices from various manufacturers. C12.22 is the designation of the latest subclass of the ANSI C12.xx family of Meter Communication and Data standards presently under development. Presently defined standards include. ANSI C12.18 relating to protocol specifications for Type 2 optical ports; ANSI C12.19 relating to Utility industry Meter Data Table definitions; and ANSI C12.21 relating to Plain Old Telephone Service (POTS) transport of C12.19 Data Tables definition. It should be appreciated that while the remainder of the present discussion may describe C12.22 as a standard protocol, that, at least at the time of filing the present application, such protocol is still being developed so that the present disclosure is actually intended to describe an open protocol that may be used as a communications protocol for networked metrology and is referred to for discussion purposes as the C12.22 standard or C12.22 protocol.

C12.22 is an application layer protocol that provides for the transport of C12.19 data tables over any network medium. Current standards for the C12.22 protocol include: authentication and encryption features; addressing methodology providing unique identifiers for corporate, communication, and end device entities; self describing data models; and message routing over heterogeneous networks.

Much as HTTP protocol provides for a common application layer for web browsers, C12.22 provides for a common application layer for metering devices. Benefits of using such a standard include the provision of: a methodology for both session and session-less communications; common data encryption and security; a common addressing mechanism for use over both proprietary and non-proprietary network mediums; interoperability among metering devices within a common communication environment; system integration with third-party devices through common interfaces and gateway abstraction; both 2-way and 1-way communications with end devices; and enhanced security, reliability and speed for transferring meter data over heterogeneous networks.

To understand why utilities are keenly interested in open protocol communications; consider the process and ease of sending e-mails from a laptop computer or a smart phone. Internet providers depend on the use of open protocols to provide e-mail service. E-mails are sent and received as long as e-mail addresses are valid, mailboxes are not full, and communication paths are functional. Most e-mail users have the option of choosing among several Internet providers and several technologies, from dial-up to cellular to broadband, depending mostly on the cost, speed, and mobility. The e-mail addresses are in a common format, and the protocols call for the e-mail to be carried by communication carriers without changing the e-mail. The open protocol laid out in the ANSI C.12.22 standard provides the same opportunity for meter communications over networks.

In addition, the desire for increased communications capabilities as well as other considerations including, but not limited to, a desire to provide improved radio frequency transmission range for individual metrology components in an open operational framework, leads to requirements for improved antenna components for metrology devices including meters installed in such systems.

As such, it is desired to provide an improved antenna for coupling utility meters by radio frequency signals to other system components in an open operational framework.

While various aspects and alternative embodiments of antenna configurations may be known in the field of utility metering, no one design has emerged that generally encompasses the above-referenced characteristics and other desirable features associated with utility metering technology as herein presented.

SUMMARY OF THE INVENTION

In view of the recognized features encountered in the prior art and addressed by the present subject matter, an improved radio frequency antenna configuration for incorporation within a metrology device for use in an open operational framework has been provided.

In an exemplary arrangement, an antenna has been provided to permit transmission of information between a utility meter and an operational application through a network.

In one of its simpler forms, the present technology provides a patch antenna structure to permit omni-directional transmission of radio frequency signals between a local area network and a meter installed within the service area of the local area network of a utilities service provider.

One positive aspect of the antenna is that it provides an improved, protected mounting arrangement "under the glass" of a utility meter.

Another positive aspect of this type of antenna is that simplified construction techniques may be employed to produce conductive elements for the antenna.

Yet another positive aspect of the antenna is that it isolates non-radio frequency circuitry for the electromagnetic field generated by the antenna.

One exemplary present embodiment relates to an improved antenna for mounting under the glass of utility meters for coupling thereof by radio frequency signals to other system components in an open operational framework. Such antenna preferably may comprise an insulating substrate and first and second conductive layers. More preferably, such insulating substrate may have major front and rear surfaces, and respective lateral ends. At the same time, such first conductive layer preferably may be secured on the rear surface of such substrate, and may define a slot shaped opening therein, with such first conductive layer except for the slot shaped opening thereof covering substantially the entire rear surface of such substrate. Also, such second conductive layer may preferably be secured on the front surface of such substrate, and preferably may cover substantially equally portions of such substrate from the slot shaped opening of such first conductive layer toward the lateral ends of such substrate but short of such lateral ends so as to leave predetermined substantially equal area substrate portions left uncovered on such substrate front surface.

Still further present alternatives to such exemplary embodiment may involve the inclusion of additional features, for example, such as providing such insulating substrate as generally arc-shaped; and such providing such first conductive layer as a conductive ground plane element for such antenna, configured for facing the electronics of an associated utility meter, while such second conductive layer comprises a radiating element of such antenna. With such structure in combination with a utility meter associated non-radio frequency electronics of such utility meter are preferably isolated from an electromagnetic field generated by such antenna while permitting omni-directional transmission of radio frequency signals via such antenna to other system components in an open operational framework.

Other present exemplary embodiments more directly relate to a meter with an under the glass antenna for use with an open operational framework employing a radio frequency local area network. Such a meter may preferably comprise a metrology printed circuit board including components relating to the collection and display of metrology information; radio transmission components received on such circuit board; a microstrip feedline connected with such radio transmission components and received on the circuit board; and an antenna secured to the printed circuit board for support thereof, and electrically grounded thereto. In the foregoing exemplary embodiment, preferably such antenna may include an insulating substrate, with respective first and second conductive layers on opposite surfaces of such substrate, and with such antenna positioned relative to the circuit board and the microstrip feedline received thereon for inductive coupling therewith.

It is to be understood that the present subject matter equally relates to various present methodologies. One exemplary such present embodiment relates to methodology for providing a patch antenna for mounting under the glass of utility meters for coupling thereof by radio frequency signals to other system components in an open operational framework. Such exemplary methodology may comprise providing an insulating substrate having major front and rear surfaces, and respective lateral ends; securing a first conductive layer on such rear surface of the substrate, covering substantially the entire rear surface of such substrate except for a slot shaped opening defined in such first conductive layer; and securing a second conductive layer on such front surface of the substrate, such that substantially equal portions of such substrate are covered from the slot shaped opening of such first conductive layer toward the lateral ends of such substrate but short of such lateral ends so as to leave predetermined substantially equal area substrate portions left uncovered on the substrate front surface.

Other exemplary present methodology relates to methodology for providing a meter with an under the glass antenna for use with an open operational framework employing a radio frequency local area network. Such present exemplary methodology may comprise providing a metrology printed circuit board having thereon components relating to the collection and display of metrology information; providing radio transmission components on such circuit board; supporting on such circuit board a microstrip feedline connected with such radio transmission components; providing an antenna including an insulating substrate, and respective first and second conductive layers on opposite surfaces of such substrate; and securing the antenna to the printed circuit board for support thereof, and electrically grounded thereto, and with such antenna positioned relative to the circuit board and the microstrip feedline received thereon for inductive coupling therewith. It is to be understood of all the present exemplary methodologies that other present methodologies may be provided by various inclusions of other exemplary method features otherwise disclosed herein, each such variations constituting further present methodologies.

Additional objects and advantages of the present subject matter are set forth in, or will be apparent to, those of ordinary skill in the art from the detailed description herein. Also, it should be further appreciated that modifications and variations to the specifically illustrated, referred and discussed features and elements hereof may be practiced in various embodiments and uses of the present subject matter without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the present subject matter may include various combinations or configurations of presently disclosed features, steps, or elements, or their equivalents including combinations of features, parts, or steps or configurations thereof not expressly shown in the figures or stated in the detailed description of such figures. Additional embodiments of the present subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 2:
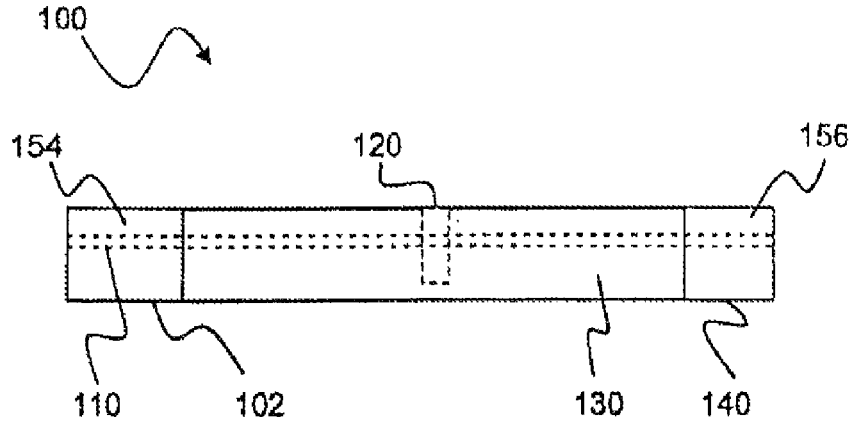
FIG. 2 is a front plan view of an exemplary antenna in accordance with the present subject matter seen from the perspective of section 2-2 of FIG. 1.

Repeat use of reference characters throughout the present specification and appended drawings is intended to represent same or analogous features or elements of the present subject matter.

DETAILED DESCRIPTION OF THE PREFERRED EMBODIMENTS

As discussed in the Summary of the Invention section, the present subject matter is particularly concerned with the provision of an improved radio frequency antenna configuration for incorporation within a metrology device for use in an open operational framework.

Selected combinations of aspects of the disclosed technology correspond to a plurality of different embodiments of the present subject matter. It should be noted that each of the exemplary embodiments presented and discussed herein should not insinuate limitations of the present subject matter. Features or steps illustrated or described as part of one embodiment may be used in combination with aspects of another embodiment to yield yet further embodiments. Additionally, certain features may be interchanged with similar devices or features not expressly mentioned which perform the same or similar function.

Reference will now be made in detail to the presently preferred embodiments of the subject antenna. Referring now to the drawings, and referring first to FIG. 5 there is illustrated a block diagram overview of an Advanced Metering System (AMS) 500 in which an antenna constructed in accordance with the present subject matter may be installed along with certain of the metrology components.

Advanced Metering System (AMS) 500 is designed to be a comprehensive system for providing advanced metering information and applications to utilities. AMS 500 is build around industry standard protocols and transports, and is designed to work with standards compliant components from third parties.

Major components of AMS 500 include meters 542, 544, 546, 548, 552, 554, 556, 558; one or more radio networks including RF local area network (RF LAN) 562 and accompanying Radio Relay 572 and power line communications neighborhood area network (PLC NAN) 564 and accompanying PLC Relay 574; an IP based Public Backhaul 580; and a Collection Engine 590. Other components within AMS 500 include a utility LAN 592 and firewall 594 through which communications signals to and from Collection Engine 590 may be transported from and to meters 542, 544, 546, 548, 552, 554, 556, 558 or other devices including, but not limited to, Radio Relay 572 and PLC Relay 574.

AMS 500 is configured to be transportation agnostic or transparent; such that meters 542, 544, 546, 548, 552, 554, 556, 558 may be interrogated using Collection Engine 590 regardless of what network infrastructure lay in between. Moreover, due to this transparency, the meters may also respond to Collection Engine 590 in the same manner.

Figure 5:
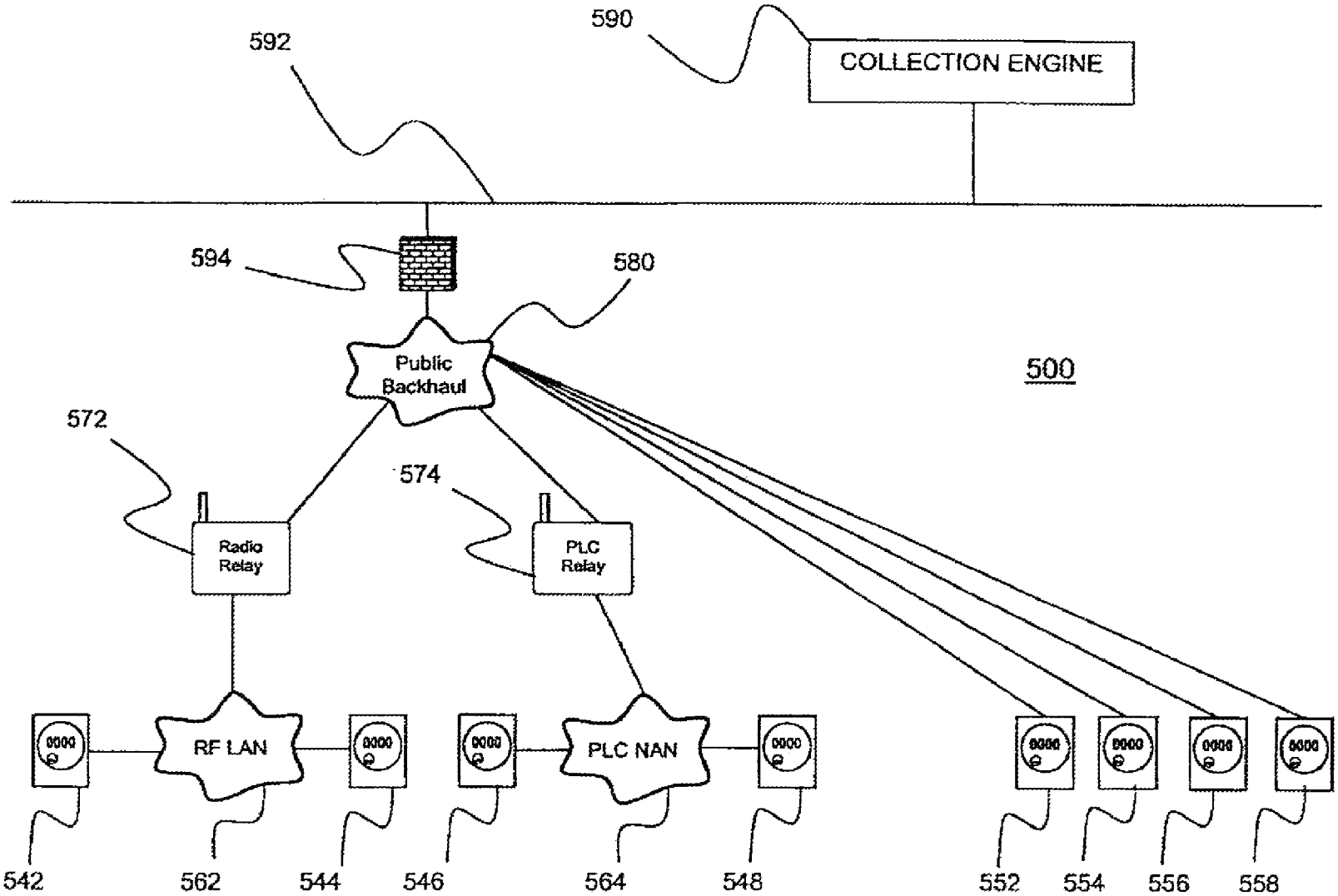
FIG. 5 is a block diagram overview illustration of an Advanced Metering System (AMS) in accordance with the present subject matter.

As illustrated in FIG. 5, Collection Engine 590 is capable of integrating Radio, PLC, and IP connected meters. To facilitate this transparency, AMS 500 uses ANSI C12.22 meter communication protocol for networks. C12.22 is a network transparent protocol, which allows communications across disparate and asymmetrical network substrates. C12.22 details all aspects of communications, allowing C12.22 compliant meters produced by third parties to be integrated into a single advanced metering interface (AMI) solution. AMS 500 is configured to provide meter reading as well as load control/demand response, in home messaging, and outage and restoration capabilities. All data flowing across the system is sent in the form of C12.19 tables. The system provides full two-way messaging to every device; however, many of its functions may be provided through broadcast or multicast messaging and session-less communications.

In accordance with the present subject matter, the disparate and asymmetrical network substrates may be accommodated by way of a native network interface having the capability to plug in different low level transport layers using .NET interfaces. In accordance with an exemplary configuration, Transmission Control Protocol/Internet Protocol (TCP/IP) may be employed and may involve the use of radio frequency transmission as through RF LAN 562 via Radio Relay 572 to transport such TCP/IP communications. It should be appreciated that TCP/IP is not the only such low-level transport layer protocol available and that other protocols such as User Datagram Protocol (UDP) may be used.

Figure 1:
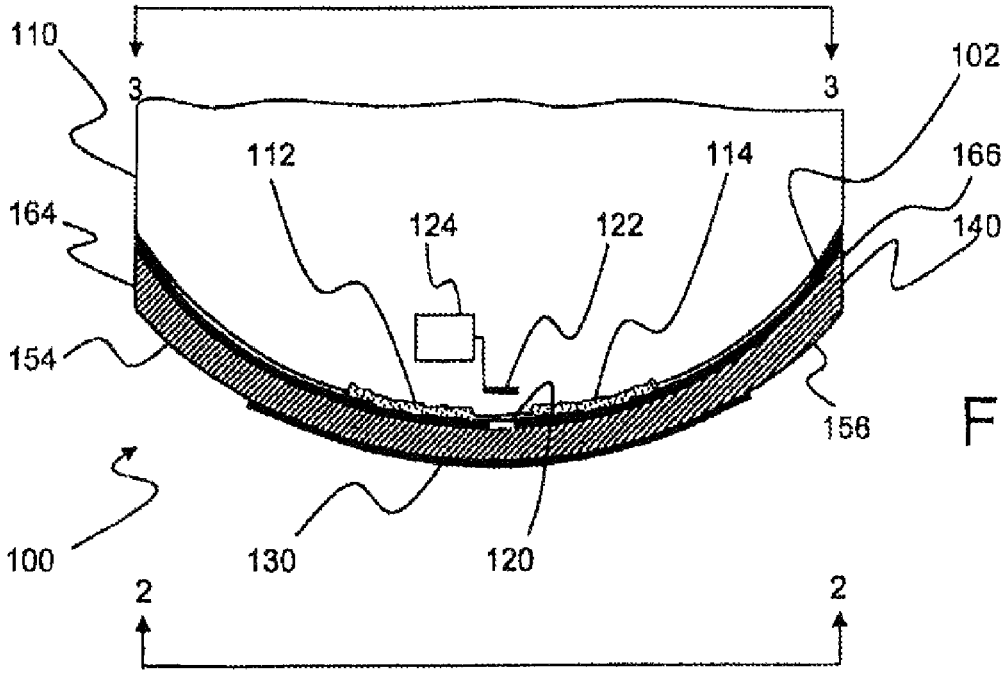
FIG. 1 is an edge view of an exemplary antenna constructed in accordance with the present subject matter attached to a metrology printed circuit board.
Figure 3:
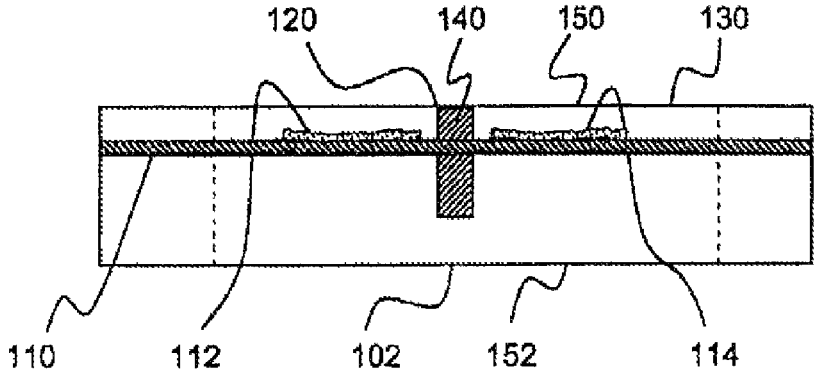
FIG. 3 is a rear plan view of an exemplary antenna constructed in accordance with the present subject matter seen from the perspective of section 3-3 of FIG. 1.

With reference now to FIGS. 1, 2 and 3, edge, front plan, and rear plan views respectively of a patch antenna 100 constructed in accordance with the present subject matter are illustrated. In an exemplary embodiment a patch antenna 100 may be constructed by first providing a generally arc-shaped, insulating substrate 140 having major front and back surfaces. Electrically conductive material may be secured on both the front and rear major surfaces in a manner to be described later.

In accordance with an exemplary embodiment of the present subject matter, patch antenna 100 may be formed by providing a first conductive layer 102 on the rear major surface of substrate 140 covering substantially the entire rear portion of substrate 140 except for a slot shaped portion 120 removed from first conductive layer 102 (and creating a corresponding slot shaped opening) starting at a first edge 150 of substrate 140 and extending toward but not reaching a second edge 152. As most clearly illustrated in FIG. 3, substrate material 140 may be seen behind slot 120. First conductive layer 102 may be soldered to traces secured to a perimeter portion of printed circuit board 110 as illustrated at 112, 114. Soldering of first conductive layer 102 to traces on printed circuit board 110 provides, among other things, a convenient mounting technique for mounting the antenna to the meter.

A second conductive element 130 may be secured to the front portion of substrate 140. Second conductive element 130 may be affixed to the front major surface of substrate 140 and extends from first edge 150 of substrate 140 to second edge 152 of substrate 140 and covers substantially equally portions of substrate 140 from the slot 120 (on the rear side of substrate 140) toward lateral ends 164, 166 of substrate 140 but short of the lateral ends 164, 166 leaving substantially equal area substrate portion 154, 156 left uncovered. Second electrically conductive element 130 forms the radiating element for patch antenna 100 and may be approximately half-wavelength of the operating frequency of the antenna in length.

First and second electrically conductive elements 102, 130 may both correspond to any suitable electrically conductive material that may be adhered in any suitable fashion to substrate material 140. Suitable materials for conductive elements 102 and 130 may include, but are not limited to, aluminum, copper, and brass. Substrate material 140 may correspond to any suitable non-conductive or insulating material and may correspond to a transparent plastic material.

In accordance with the present subject matter, conductive elements 102, 130 may be secured to substrate 140 in any suitable manner including, but not limited to, mechanical devices including screws, and pop rivets, as well as by adhesives. In a particularly advantageous embodiment, conductive elements 102, 130 may be formed by hot stamping conductive material directly on to the front and rear surfaces of substrate 140.

With further reference to FIG. 1, it will be noticed that a microstrip 122 may be formed on one surface of printed circuit board 110. Microstrip 122 is place on the printed circuit board 110 so that when substrate 140 and its attached first and second conductive elements 102, 130 are secured to printed circuit board 110, microstrip 122 will be positioned perpendicularly across a generally central portion of the gap created by slot 120 in first conductive element 102. In this manner microstrip 122 operates as a feedline for patch antenna 100 so that an inductive aperture coupling to the radiating element corresponding to first conductive element 102 is formed. The use of an inductive aperture coupling as opposed to more traditional conductive coupling provides for galvanic isolation of the patch and permits feeding the patch from the non-coplanar printed circuit board 110.

Figure 4:
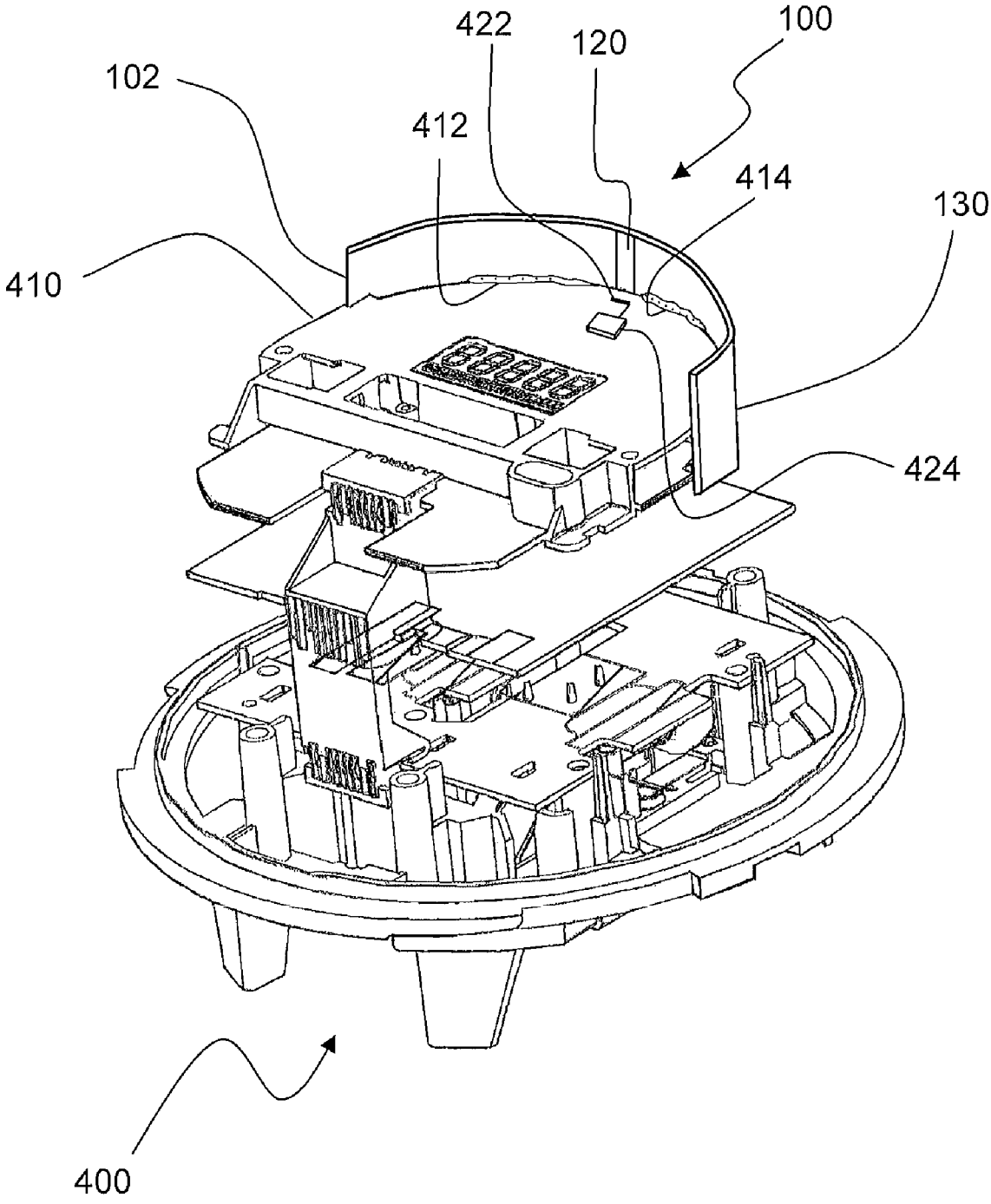
FIG. 4 is an isometric view of a utility meter incorporating an antenna constructed in accordance with the present subject matter.

With reference now to FIG. 4, there is illustrated an isometric view of a utility meter 400 incorporating an antenna constructed in accordance with the present subject matter. As may be seen in FIG. 4, utility meter 400 includes a printed circuit board 410 on which may be mounted a number of components relating to the collection and display of metrology information.

In accordance with the present subject matter, circuit board 410 may include a feedline microstrip 422 (corresponding with microstrip 122 of present FIG. 1) and may include radio transmission circuit components 424, and may be secured as illustrated by solder connections 412, 414 to antenna 100 and conductive traces printed on printed circuit board 410. The soldered connections 412, 414 to printed circuit board 410 provide a solid physical connection of the antenna to printed circuit board 410 as well as an electrical connection to the electrical ground portion of the metrology circuitry associated with meter 400.

This electrical connection of first conductive element 102 of patch antenna 100 not only provides a ground plane portion for patch antenna 100 but also provides a shielding function to shield various of the metrology components mounted on printed circuit board 410 and other printed circuit boards associated with meter 400 from radio frequency energy radiated from the patch antenna.

With further reference to FIG. 4 it will be noticed that antenna 100 may be mounted with respect to the metrology board of meter 400 so that when the meter is mounted for use within the network, the patch antenna 100 will be positioned at the top of the meter and under the glass enclosure for the meter. Such a location permits an upwardly directed omnidirectional radiating pattern from the antenna while protecting the antenna and individuals who may otherwise come in contact with the antenna had it been provided as an external antenna.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. An improved-antenna for mounting under the housing of utility meters for coupling thereof by radio frequency signals to other system components, said antenna comprising:

an insulating substrate having major front and rear surfaces, and respective lateral ends;

a first conductive layer secured on said rear surface of said substrate, and defining a slot shaped opening therein, said slot shaped opening starting from a first edge of said substrate and extending toward but not reaching a second edge of said substrate, said first conductive layer except for said slot shaped opening thereof covering substantially the entire rear surface of said substrate; and a second conductive layer secured on said front surface of said substrate, and covering substantially equally portions of said substrate from said slot shaped opening of said first conductive layer toward said lateral ends of said substrate but short of said lateral ends so as to leave predetermined substantially equal area substrate portions left uncovered on said substrate front surface.

2. The antenna is in claim 1, wherein:

said insulating substrate is generally arc-shaped.

3. The antenna as in claim 2, wherein the length of said second conductive layer is approximately half-wavelength of the operating frequency of said antenna.

4. The antenna as in claim 1, further including mechanical devices for respectively securing said first and second conductive layers directly on said substrate.

5. The antenna as in claim 1, wherein said first and second conductive layers respectively comprise hot stamped material supported directly on said substrate.

6. The antenna as in claim 1, wherein said substrate comprises a plastic material, and said first and second conductive layers respectively comprise one of aluminum, copper, and brass.

7. A meter with an under the housing antenna for use employing a radio frequency local area network, comprising:

a metrology printed circuit board including components relating to the collection and display of metrology information;

radio transmission components received on said circuit board;

a microstrip feedline connected with said radio transmission components and received on said circuit board; and an antenna secured to said printed circuit board for support thereof, and electrically grounded thereto, said antenna including an insulating substrate, with respective first and second conductive layers on opposite surfaces of said substrate;

wherein said first conductive layer comprises a ground plane of said antenna, and said second conductive layer comprises a radiating element of said antenna, said first conductive layer being positioned between said second conductive layer and the metrology printed circuit board to isolate said metrology printed circuit board from an electromagnetic field generated by said second conductive layer.

8. The meter as in claim 7, wherein:

said substrate has major rear and front surfaces, on which said first and second conductive layers are respectively supported, and said substrate has respective lateral ends;

said first conductive layer secured on said rear surface of said substrate defines a slot shaped opening therein, said first conductive layer except for said slot shaped opening thereof covering substantially the entire rear surface of said substrate; and said second conductive layer secured on said front surface of said substrate covers substantially equally portions of said substrate from said slot shaped opening of said first conductive layer toward said lateral ends of said substrate but short of said lateral ends so as to leave predetermined substantially equal area substrate portions left uncovered on said substrate front surface.

9. The meter as in claim 8, wherein:

said insulating substrate is generally arc-shaped.

10. The meter as in claim 8, wherein the length of said second conductive layer is approximately half-wavelength of the operating frequency of said antenna.

11. The meter as in claim 7, wherein said insulating substrate comprises a plastic material, and said first and second conductive layers respectively comprise one of aluminum, copper, and brass.

12. Methodology for providing a patch antenna for mounting under the housing of utility meters for coupling thereof by radio frequency signals to other system components, comprising:

providing an insulating substrate having major front and rear surfaces, and respective lateral ends;

securing a first conductive layer on such rear surface of the substrate, covering substantially the entire rear surface of such substrate except for a slot shaped opening defined in such first conductive layer, said slot shaped opening starting from a first edge of said substrate and extending toward but not reaching a second edge of said substrate; and securing a second conductive layer on such front surface of the substrate, such that substantially equal portions of such substrate are covered from the slot shaped opening of such first conductive layer toward the lateral ends of such substrate but short of such lateral ends so as to leave predetermined substantially equal area substrate portions left uncovered on the substrate front surface.

13. The methodology as in claim 12, wherein:

the insulating substrate is generally arc-shaped.

14. The methodology as in claim 13, wherein the length of the second conductive layer is approximately half-wavelength of the operating frequency of the antenna.

15. The methodology as in claim 12, further including respectively securing the first and second conductive layers directly on the substrate through the use of mechanical devices.

16. The methodology as in claim 12, further comprising providing the first and second conductive layers respectively as hot stamped material supported directly on the substrate.

17. The methodology as in claim 12, wherein the substrate comprises a plastic material, and the first and second conductive layers respectively comprise one of aluminum, copper, and brass.

18. Methodology for providing a meter with an under the housing antenna for use with framework employing a radio frequency local area network, comprising:

providing a metrology printed circuit board having thereon components relating to the collection and display of metrology information;

providing radio transmission components;

supporting on such circuit board a microstrip feedline connected with such radio transmission components;

providing an antenna including an insulating substrate, and respective first and second conductive layers on opposite surfaces of such substrate; and securing the antenna to the printed circuit board for support thereof, and electrically grounded thereto, wherein said first conductive layer comprises a ground plane of said antenna, and said second conductive layer comprises a radiating element of said antenna, said first conductive layer being disposed between said second conductive layer and said metrology printed circuit board of said utility meter to isolate such metrology printed circuit board from an electromagnetic field generated by said second conductive layer.

19. The methodology as in claim 18, further comprising:

providing such substrate with major rear and front surfaces, and with such first and second conductive layers respectively supported thereon, and providing the substrate with respective lateral ends;

providing such first conductive layer secured on the rear surface of such substrate so as to define a slot shaped opening therein, with the first conductive layer except for the slot shaped opening thereof covering substantially the entire rear surface of such substrate; and providing such second conductive layer secured on the front surface of such substrate so as to cover substantially equally portions of such substrate from the slot shaped opening of such first conductive layer toward the lateral ends of the substrate but short of such lateral ends so as to leave predetermined substantially equal area substrate portions left uncovered on such substrate front surface.

20. The methodology as in claim 19, wherein:

the insulating substrate is generally arc-shaped.

21. The methodology as in claim 19, wherein:

the length of the second conductive layer is approximately half-wavelength of the operating frequency of such antenna; and the insulating substrate comprises a plastic material, and the first and second conductive layers respectively comprise one of aluminum, copper, and brass.

* * * * *

UNITED STATES PATENT AND TRADEMARK OFFICE

CERTIFICATE OF CORRECTION

PATENT NO. : 8,284,107 B2
APPLICATION NO. : 12/955616
DATED : October 9, 2012
INVENTOR(S) : Vladimir Borisov et al.

It is certified that error appears in the above-identified patent and that said Letters Patent is hereby corrected as shown below:

On the Title Page

In line 12 of the Abstract, please delete the word "feed" and replace with the word "fed"

Please correct the information for the following reference listed on Page 2 of the original patent document

| | | |
|---|---|---|
| 6,816,538 | 11/2004 | Shuey et al. |

In the Claims

In Column 10, line 14 (Claim 8), please delete the word "equally" and replace with the word "equal"

In Column 12, line 8 (Claim 19), please delete the word "equally" and replace with the word "equal"

Signed and Sealed this
Thirtieth Day of June, 2015

Michelle K. Lee

Michelle K. Lee
*Director of the United States Patent and Trademark Office*